United States Patent [19]

Young et al.

[11] 4,379,521

[45] Apr. 12, 1983

[54] SPRING RAIL FASTENING SYSTEM

[75] Inventors: Hartley F. Young, Melton, Australia; Hendrikus M. Verhoef, deceased, late of Broadview, Australia, by Edmund M. Verhoef, executor; Wally A. Remes, Redwood Park, Australia

[73] Assignee: Ralph McKay Limited, Victoria, Australia

[21] Appl. No.: 218,109

[22] Filed: Dec. 19, 1980

[30] Foreign Application Priority Data

Dec. 19, 1979 [AU] Australia ..... 54004/79

[51] Int. Cl.[3] ..... E01B 9/30; E01B 21/04; E01B 29/24

[52] U.S. Cl. ..... 238/349; 238/310; 238/351

[58] Field of Search ..... 238/310, 349, 351

[56] References Cited

U.S. PATENT DOCUMENTS

| | | | |
|---|---|---|---|
| 3,021,076 | 2/1962 | Finch | 238/349 X |
| 3,067,947 | 12/1962 | Deenik et al. | 238/349 X |
| 3,314,605 | 4/1967 | Waters | 238/349 X |
| 3,827,631 | 8/1974 | Kirk | 238/349 X |
| 3,881,652 | 5/1975 | Jacobson | 238/349 |
| 3,970,248 | 7/1976 | Molymeux | 238/349 |
| 3,982,692 | 9/1976 | Feyrer et al. | 238/349 |
| 4,025,044 | 5/1977 | Goderbauer | 238/349 |
| 4,053,107 | 10/1977 | Goderbauer | 238/349 |
| 4,313,563 | 2/1982 | Young | 238/349 |

FOREIGN PATENT DOCUMENTS

| | | | |
|---|---|---|---|
| 1162585 | 4/1958 | France | 238/349 |
| 184708 | 8/1963 | Sweden | 238/349 |
| 186334 | 11/1963 | Sweden | 238/349 |
| 861473 | 2/1961 | United Kingdom | 238/349 |

*Primary Examiner*—Robert B. Reeves
*Assistant Examiner*—Howard Beltran
*Attorney, Agent, or Firm*—Buell, Blenko, Ziesenheim & Beck

[57] ABSTRACT

A rail fastening system for securing rails to rail ties in which an elastic fastener is used. The fastener has one portion which lies on the rail flange and a second portion which seats within a support secured to the rail tie. The fastener comprises a base portion which seats within the support and two tapered arms which are curved over the base so that the free ends of the tapered arms lie on the rail flange. The support is located adjacent the rail flange and a locking element fits between the rail flange and the support and is shaped to interfit with the support in a wedge-like relationship such that longitudinal rail movement acting on the locking element is translated into a lateral force to prevent longitudinal rail movement.

3 Claims, 12 Drawing Figures

FIG. 3
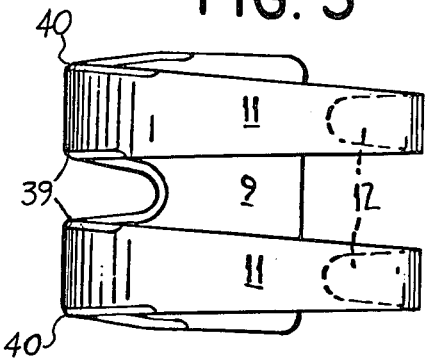
FIG. 6
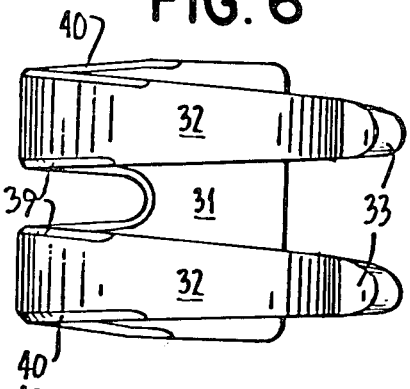
FIG. 4
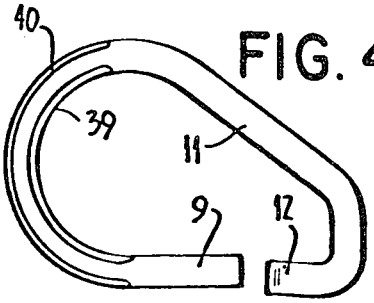
FIG. 7
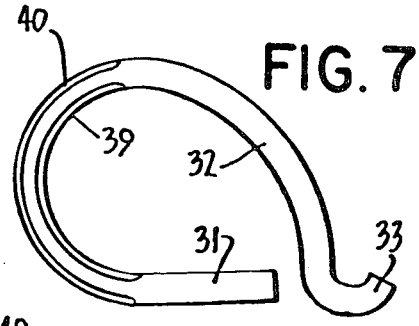
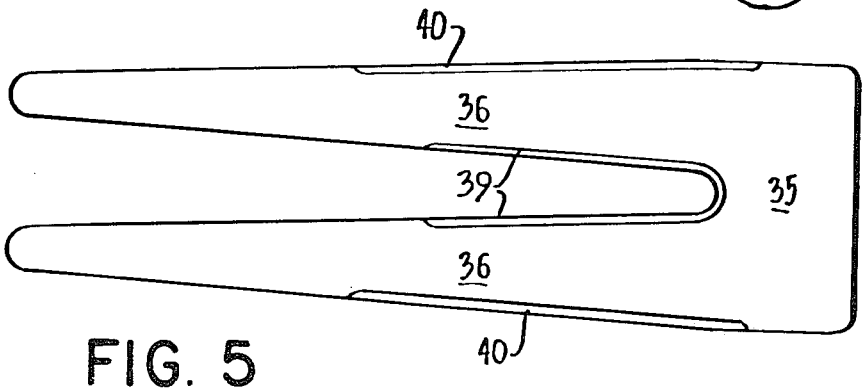
FIG. 5

SPRING RAIL FASTENING SYSTEM

This invention relates to a system of fastening railway rails to ties. In particular it relates to an elastic rail fastening system capable of retarding both lateral and longitudinal movement of the rails under a variety of rail and tie conditions.

A wide variety of elastic rail fastening systems have been proposed.

It has been proposed to use elastic fastenings of different types. In one form this comprises a plate forming an upper leg, which is then bent to form a lower leg. the upper leg being adapted to hold down the foot of the rail, the lower leg providing an elastic sideways check on the rail, both the legs being secured to the tie through a bolt.

Another type of elastic fastening comprises a clamp of resilient material which consists of three portions of which one portion exerts a bearing pressure on the upper surface of the bottom flange on one side of the rail, while another portion passing uner the rail exerts a bearing pressure on the upper surface of the bottom flange on the opposite side of the rail. Then there is a third portion which with the fastener under the state of stress is adapted to be engaged by a pin inserted in a hole in the tie.

Another known type of such fastening is a British type called "Pandrol" (Trademark) which comprises a single looped bar forming two legs and a loop, substantially like the formation of the letter C with its ends extended. The curved portion is seated on the foot of the rail to hold down the rail, one leg thereof engaging a bore in a lug or protrusion formed with the tie, the second leg being free and kept on the tie. See U.K. Pat. No. 861473.

Another known type is the Mills described in French Pat. No. 1,162,585 and Swedish Pat. No. 186,334 which consists of a single curved arm tapered toward each end from the central curved portion. This is a simple clip easily removeable from the rail flange and requiring a special rail tie because both ends of the clip lie above or below the rail flange.

Another popular system is described in U.S. Pat. No. 4,025,044 Goderbauer.

Although each of the above systems provide a basic elastic fastening system they have many drawbacks.

For example in the Pandrol system the clip can be easily removed, by a hammer blow, from the clipholder and thus a railway line fitted with Pandrol clips can be easily sabotaged and furthermore clips can become loosened by vibration during use. Another drawback of these prior art clips is the limited range of deflection of the clips which provides an adequate clamping force. Both Pandrol and the clip disclosed in Goderbauer have only a 2 to 4 mm working deflection range within which an adequate clamping force is exerted onto the rail flange without over stressing the rail clip. Thus variations in the distance between the clipholder and the rail flange for each rail seat must be within the 2 to 4 mm range. Further movement of the rail and tie during use must not exceed this narrow range or the rail will not be held firmly and may move or the clip will be overstressed and may become fatigued or fractured.

Thus it is an object of this invention to provide a rail fastening system which is able to function even where large misalignments occur between rail flange and the clipholder.

Any rail fastening system must be able to maintain the rail in position under the normal stress conditions arising from use of the rails and from environmental stresses particularly thermal stresses. Modern rail systems are adopting welded rails and thermal stresses are a predominant factor in welded rails. It has been observed that a major long term difficulty with rails is the tendency of the rails to move in the predominant direction of travel for trains on the rail track. This tendency is called rail creep and it is most important that any elastic rail fastening systems not only prevent lateral rail movement but also prevent axial movement or rail creep.

Past attempts to reduce rail creep have concentrated on increasing the hold down force of the rail clip on the rail flange or on increasing the frictional resistance between the rail, the tie and the clip by, for example, carefully selected materials to be used as rail pads between the rail and the tie.

It is an object of this invention to reduce rail creep as compared to conventional elastic fastening systems.

With most rail systems an insulator must be between the foot of the rail and the rail clip. When the clip is pushed into the clip holder and onto the foot of the rail this insulator (generally nylon or high density polyethylene) is torn or pushed away so that it does not effectively separate the clip and the rail foot. It must be remembered that the clamping force of each clip is of the order of 9 kilonewtons (2025 pounds) and it is therefore difficult to insert clips onto the rail foot without damaging the insulator layer. Generally the rail clip holders are castings including a portion adapted to secure the holder to a tie and a recessed portion adapted to receive a free end of a rail clip.

The castings are expensive to produce and require a large metal content which also contributes to cost. The castings need to be relatively heavy and to include thick flanges in the recessed portion to retain the free ends of the clip in position.

It is an object of this invention to provide a simple alternative form of clip holder which is cheaper to produce, contains less metal and is still as effective functionally as previous clips.

In order to overcome the problems of the prior art the present invention provides A rail fastening system by which a rail is secured, by elastic rail clips mounted on the rail flange, to a tie comprising in combination (a) an elastic rail clip comprising a U-shaped member having a base and two arms extending therefrom, said base adapted to be secured to said tie outwardly spaced from the foot of said rail, said arms being bent inwardly beyond said base and oriented for contact with the flange of said rail such that said arms are deflected upwardly relative to said rail to develop downward clamping forces tending to hold said rail on said tie; preferably each arm of the clip is tapered and this tapering is preferably substantially uniformly over the entire length of each arm; (b) a clip holder comprising a member adapted to be secured to a rail tie said member including a recess for a first portion of a rail fastening clip and an upwardly inclined surface on that part of the member adapted to be adjacent the foot of a rail, such that the top edge of said inclined surface is at or above the level of the foot of said rail; preferably the clipholder is formed from metal plate in which the plate is bent into a general U shaped body portion the sides of the U being slotted toward the base of the U said slots being adapted to receive said one portion of the rail clip; (c) a rail locking element adapted for location between the clipholder and the rail flange the locking element interfitting with said clipholder in a wedge-like relationship such that movement of the locking element in the longitudinal direction of the rail is translated into a holding force perpendicular to the edge of the rail flange; preferably this locking element also doubles as a rail insulator situated between the ends of the clip arms and said rail flange and is preferably formed of material which creates a high co-efficient of friction with the rail, and preferably (d) an insulator pad for location between the rail and the tie said pad being of material which preferably creates a high co-efficient of friction with the rail and tie.

The term tapering is meant to include any progressive reduction in the cross sectional dimensions of the arms. For example, instead of uniform tapering, the outer edges of the arms may be parallel with the inner edges diverging to provide all of the tapering required.

It is not necessary for the tapering to extend the full length of the arms to obtain an improved deflection range for the clip. By improving the deflection range of the clip any misalignments will have a smaller effect on the clamping force and any variations will be within acceptable limits.

Another embodiment of this invention relates to the method of forming rail clips of the general kind referred to above as well as the particular clip according to the present invention.

Generally rail clips are formed from drawn rods which are bent to a U shape and then bent to the clip form. The forming techniques required as well as the starting material itself, result in an overall expensive method of making the clips.

To overcome this problem the present invention provides a method of forming rail clips comprising supplying plate material, blanking said plate to form a U shaped blank and forming the blank into a rail clip in which the free ends of the U lie adjacent the base of said U.

By using plate metal to form the strips and by blanking the basic U shape a less expensive means of forming rail clips results and the rail clips have the same quality as those produced by present day conventional methods.

Where clips of this kind have been blanked from plate material the edges are often rough. It has been discovered that in areas of high stress fractures of the clips can be started from small cracks or irregularities in the edges of the clips. Thus, to reduce the occurrence of fatigue and fractures in rail clips formed by blanking the clips from metal plate the present invention provides the step of coining the edges of the blanked out clip corresponding to those edges of the finished clip, which are subject to high stress.

The coining operation provides a smooth edge surface adjacent the high stress points and eliminates the possibility of a fracture commencing from a rough edge portion.

By providing a rail clip holder in plate metal the holder can be easily and cheaply produced by stamping and bending. the U cross section of the plate is in the horizontal plane and the slot is also approximately horizontal so that any stress of the clipholder is in the plane of the metal plate and does not produce a significant bending moment on any section of the plate as the moment arm in any stress location is of very short length. this design enables relatively light weight plate to be used so that compared to conventional clip holders less material is used resulting in a lighter and cheaper clipholder.

The sides of the plate are preferably arranged to slope inwardly to guide the clip into the correct position and also to enable insertion of a portion of the clip into the slots. Further the free ends of the clip are compressed so that when they pass beyond the sides of the clip they will expand and abut the ends of the clip side walls to be thereby retained in position. The provision of the inclined surface means the free ends of the clip will ride up the inclined surface and into position onto the insulation layer covering the rail foot without undue force which tends to tear or disrupt the insulation layer.

Ideally a portion of the abutting surfaces of the locking element and the clip holder are inclined to the axis of the rail so that any movement of the locking element parallel to the rail results in the locking element being wedged inwardly against the rail, so increasing contact pressure on the rail from a horizontal lateral direction. Prior art fastening systems only applied a vertical hold down force to the rail flange. The present invention however is able to apply both a vertical and horizontal force to the rail and this additionally restrains rail creep.

From the above it can be seen that the locking element must be shaped to lie on top of the rail flange and on the shoulder or side of the rail flange so that it lies between the rail clip and the top surface of the rail flange and lies between the clip holder and side of the rail flange. Preferably the locking element includes a U shaped portion which surrounds the clipholder. The internal faces of the U portion, which abut the rail clip are either curved or inclined inwardly toward the rail ensuring that longitudinal movement is translated into the lateral direction toward the rail. It is preferred to select the material for the locking element on two criteria—strength and frictional resistance of the surface. Both metal or a reinforced plastic are considered to be suitable.

A preferred embodiment of the invention is illustrated in the accompanying drawings in which:

FIG. 3 is a plan view of a rail clip according to a first embodiment;

FIG. 4 is a side view of the clip of FIG. 1;

FIG. 5 is a plan view of a blank from which the rail clip of FIG. 4 can be formed;

FIG. 6 illustrates a top plan view of a second embodiment of clip according to this invention;

FIG. 7 is a side elevational view of the clip of FIG. 6;

Figure 1:
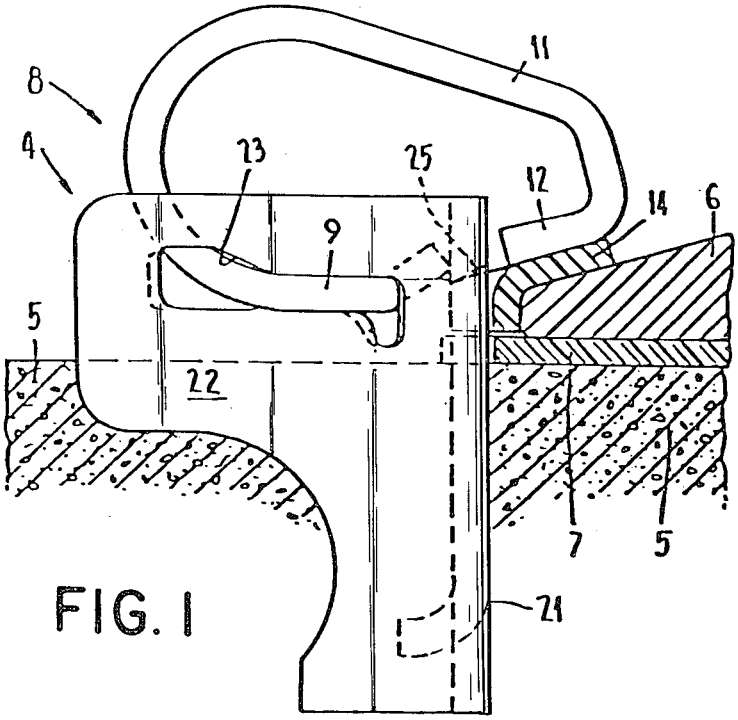
FIG. 1 is a side elevation of a rail clip of this invention.

The clipholder 4 is cast into a concrete tie 5 on which rests the rail 6. The rail 6 is separated from the tie 5 by an insulation pad 7. The rail clip 8 is secured by clip holder 4 and the clip in turn secures the rail 6 into position.

The clip comprises a base portion 9 from which extend in D configuration two arms 11 which terminate in the ends 12. These ends 12 of the clip 8 press down on the rail 6. An insulator 14 separates the rail 6 of the clip 8.

The clip of FIGS. 3 and 4 comprises a base section 9 from which the tapered arms 11 extend in an arc and terminate in free ends 12 which extend toward the base section 9.

FIGS. 6 and 7 illustrate a similar type clip having a base section 31 tapered arms 32 which arc towards the base section 31. The tapered arms 32 terminate in free ends 33 which extend away from the base section 31.

The clips of FIGS. 3 and 4 or FIGS. 6 and 7 can be manufactured from the blank illustrated in FIG. 5. The blank is 'U' shaped comprising a base 35 and arms 36 which can be bent into the shape shown in FIGS. 3 and 4 and FIGS. 6 and 7.

The deflection which can occur in practice with the two rail clips illustrated in FIGS. 3 to 7 is of the order of 15 mm and thus both clips can be used where large deflections of the rail clips are needed to fasten the rail to the tie. The tapering of the clip also improves the function and flexibility of the ends 12 of the clip. Because the clip ends 12 are more flexible they are able to adapt to variations in the positions of the rail flange and insulator 14. Thus the end 12 will always be flat on the insulator 14 and will not create undue stress. In prior art clips where the area of contact between clip and insulator is small such stress is not infrequent and results in cracking and poor wear life in the insulators.

Figure 2:
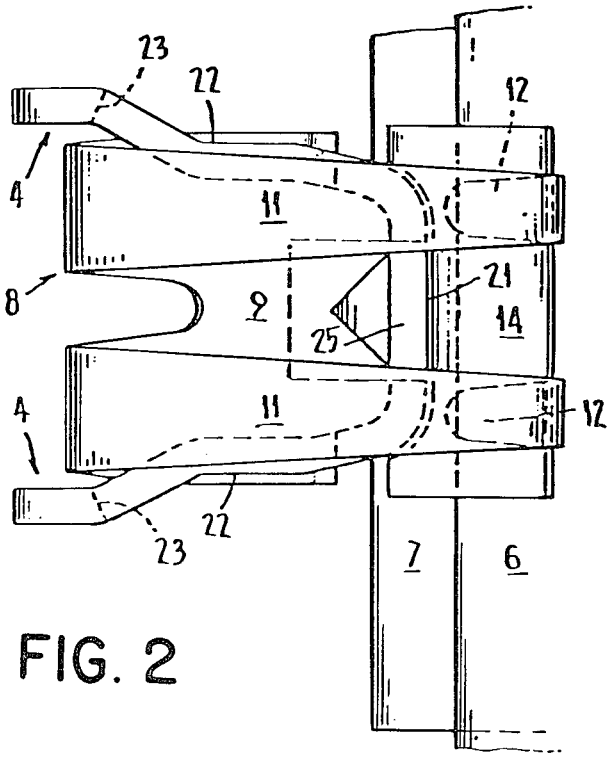
FIG. 2 is a plan view of the clip and clip holder of FIG. 1.
Figure 8:
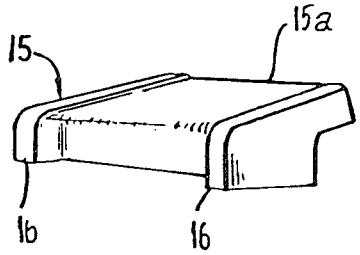
FIG. 8 is an isometric view of a locking element.
Figure 9:
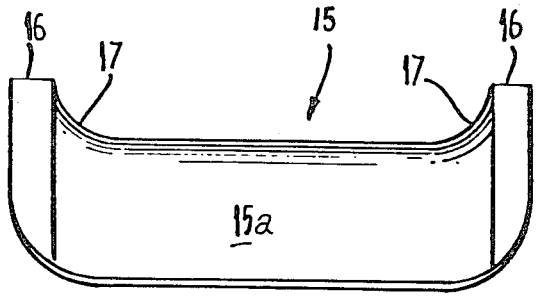
FIG. 9 is a plan view of the locking element of FIG. 8.

When the rail clip is in position as shown in FIGS. 1 or 2 any deflection of the free ends 12 relative to the base section 9 will result in major stress occurring in the internal portions 39 of the arms 11 of the clips and the base section 7. To avoid the likelihood of such stresses causing fractures the internal edge portions 39 are coined particularly in those portions of greatest curvature as shown in FIGS. 3 and 4 and 6 and 7. Generally it is only necessary to coin the internal edges 39. However it is of some value to also coin the corresponding outer edges 40.

The coining operation is preferably carried out between the blanking and forming operations. The edges to be treated are pressed with an appropriate tool to coin the edges and eliminate surface deformations.

In its preferred form the method of the present invention uses metal plate in strip form which is fed to a blanking press where a blank is formed. FIG. 5 illustrates a blank for use in forming rail clips of the kind shown in FIGS. 3, 4, 6 and 7. However, the present process is equally applicable to forming clips where the cross-sectional dimensions of the final clip are determined by the shape of the initial blank.

Following blanking the two dimensional blank is heated to below 1100° C. formed into its three dimensional form as shown in FIGS. 3, 4, 6 and 7. The product is then reheated to within the range of 820° C. to 900° C. and then quenched. Subsequent to quenching the clips are tempered in a tempering furnace to desired Rockwell hardness and are then allowed to cool prior to packing.

Figure 10:
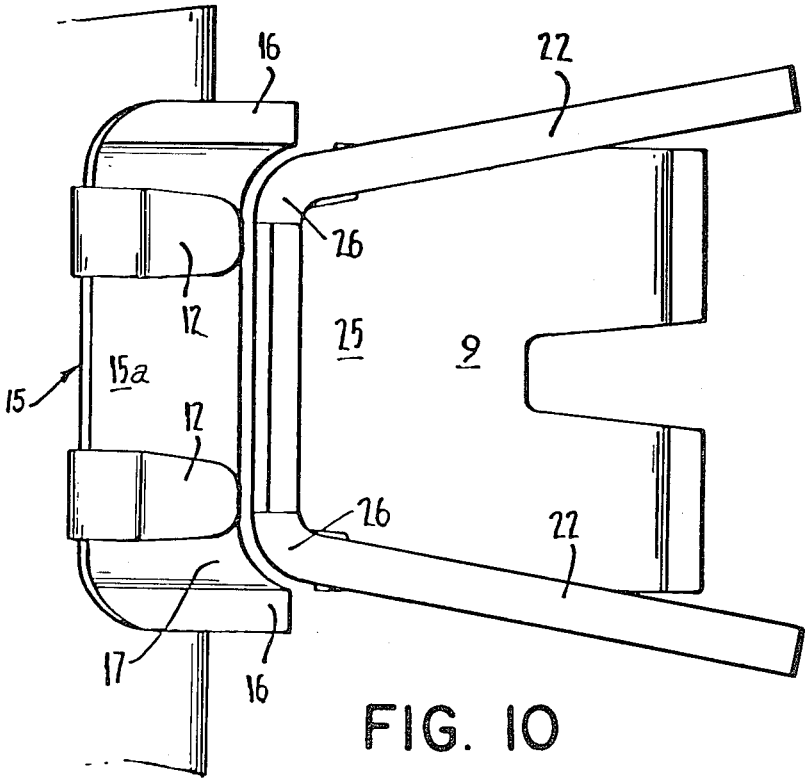
FIG. 10 is a plan view of a rail system including the rail fastener of this invention.

The clip holder 4 is shaped from metal plate into a general U shape as shown in FIG. 2 there being a central section 21 parallel to the rail and side walls 22 which taper outwardly as shown in FIG. 10 or alternatively the outward taper can be in a number of segments. The slots 23 extend through three of the tapered segments of side walls 22. The side edges of base 9 of the rail clip 8 seat within the slots 23 of the clipholder 4. The tapering of the clipholder side walls 22 causes the ends 12 of the clip to be compressed as the clip is pressed into the clipholder. However, these ends spring apart once the free ends 12 clear the end of the side walls 22. The central section 21 is of lower height than side walls 22, and includes a chamfered upper surface 25 which raises the free ends 12 of the clip 8 onto the surface of the insulator 14.

The chamfered surface 25 provides the ramp surface which assists in ensuring that the rail clip can be placed into position with minimum disturbance of the insulator.

The lower section of the clip holder 4 is conveniently shaped to enable the clipholder to be securely held in the tie which in the embodiment shown is a concrete tie.

The clipholder 4 can be stamped from metal plate to form the overall shape and to form the slots 23. Subsequent to stamping the metal plate can be bent or pressed to form the plan section as shown in FIG. 2. Because the clip 8 is held in position onto the rail 6 of the base section 9 within the slots 23 all the stress on the clip holder is within the plane of the metal plate and does not create any significant bending moment. Thus the clip holder 4 is lighter and cheaper than conventional clipholders and in addition are more easily made in large numbers.

The locking element 15 includes a portion **15*a* which lies on the rail flange and two shoulders 16 which encompass the clip holder 4. These shoulders 16 incorporate the curved faces 17 which interact with the shoulders 26 of clipholder 4**.

Any rail creep will tend to drag the locking element past the clipholder but the wedging action of the shoulders 16 of the locking element 15 and shoulders 26 of the clipholder 4 will increase the lateral hold of the locking elements on the rail flange.

In this embodiment the rail is electrified and the locking element 15 doubles as an insulator and is accordingly composed of glass filed nylon. This material has good strength and friction properties.

A comparison test was carried out in which an insulator pad having no shoulders 16 was used in the same rail fastening system as that described. A rail was dragged through the rail fastener and the resistance force measured. This test was carried out several times with the locking element of this invention and also with the locking element minus shoulders 16.

In each case there was a significant increase in the force required to achieve significant rail creep when the locking element of this invention was used. Significant rail creep is considered to occur with rail movement of from 3 to 6 mm. The smallest increase in rail creep resistance force between using a non-locking shoulder on the insulator and the locking element of this invention was 79% while the largest difference was 110%.

Figure 11:
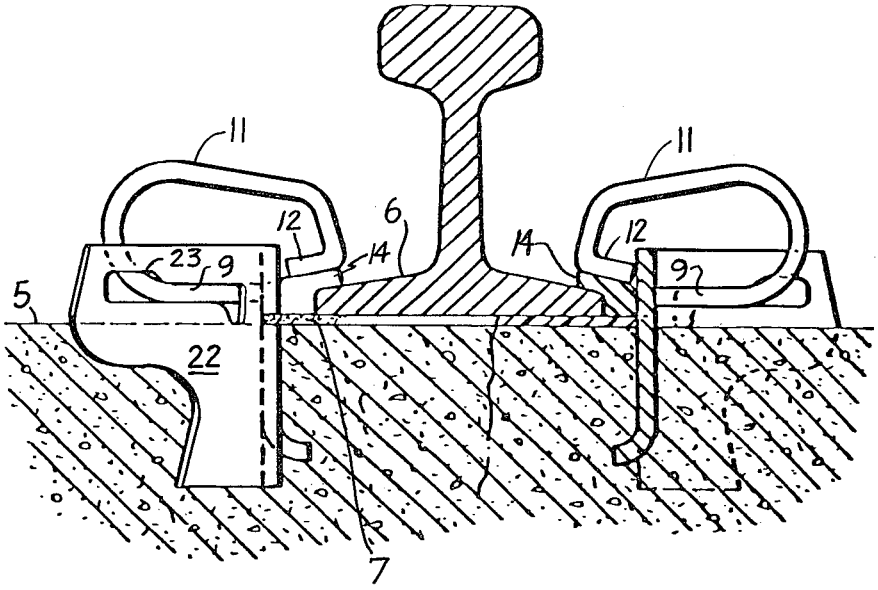
FIG. 11 is a section through a rail assembly showing two clips on opposite sides.

FIG. 11 is a view of a rail seat which comprises two rail clips 8 and their associated clipholders 4 and locking elements 15 and a single insulating pad 7 beneath the rail.

Figure 12:
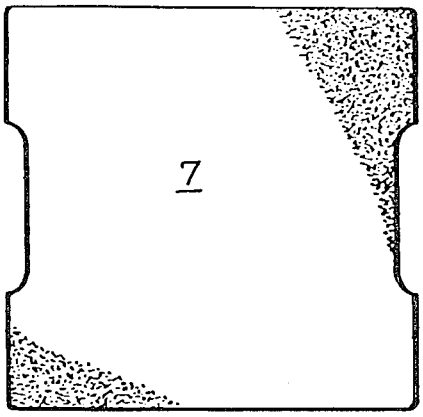
FIG. 12 is a plan view of an insulating pad for use with this invention.

This insulating pad 7 is shown in plan view in FIG. 12 and incorporates recesses which accommodate the locking elements 15.

In the preferred rail fastening system of this invention as described the working deflection range of the rail clips is 8 to 17 mm with the optimum setting being 12 mm. At a normal deflection setting of 12 mm this means the actual misalignment between the clipholder and the rail flange can be up to 4 mm higher or 5 mm lower than the optimum setting without the holding force of the clip either exceeding the stress limits of the clip or becoming too low to effectively hold the rail in place. With the clip of this invention a maximum hold down force of 24K. Newtons can be obtained using a clip weighing about 720 grams. This effective deflection range of 9 mm is much larger than the 2 to 4 mm of prior art clips such as that proposed by Goderbauer (Supra).

Because the ends 12 of the rail clip which lie on the rail flange are compressed as they pass over the lip 25 of the clipholder they expand after passing said lip and prevent removal of the rail clip except where a combination of compressive and extractive forces are used. A suitable extractive tool can be used for this purpose but it is clear that accidental removal is impossible. The presence of the lip 25 as a ramp also protects the insulator 14 from damage during insertion of the rail clip.

The clipholder is much cheaper to manufacture than the cast clipholders used in prior art systems because the clipholder of this invention can be economically and easily made from plate metal by stamping and pressing.

It is important to note that in making both the clip holder and the rail clip from metal plate no metal is wasted because interfitting blanks can be cut from suitably dimensioned steel sheets.

The locking element insulator 14 is a key element in preventing rail creep (i.e. longitudinal movement of the rail). As well because it is a separate part from the clipholder and is subject to more stress it can be easily and inexpensively replaced without replacement of the clipholder which is not the case in some prior art systems where clipholders encapsulated in insulating plastic have been used.

We claim:

1. A rail fastening system by which a rail is secured, by elastic rail clips mounted to press on the rail flange, to a tie comprising in combination (a) an elastic rail clip comprising a U-shaped member having a base and two arms extending therefrom, said base adapted to be secured to said tie outwardly spaced from the foot of said rail, said arms being bent inwardly beyond said base and oriented for contact with the flange of said rail such that said arms are deflected upwardly relative to said rail to develop downward clamping forces tending to hold said rail on said tie, said clip being formed from metal plate and each arm of the clip being tapered; (b) a clip holder adapted to be secured to a rail tie and being formed from metal plate, said clip holder comprising a vertically oriented channel section, the sides of which extend away from said rail and are slotted toward the base of the channel section which lies adjacent to said rail, said slots being adapted to receive said one portion of the rail clip, and an upwardly inclined surface on the top edge of the base of said vertically oriented channel section such that the top edge of said inclined surface is at least at the level of the foot of said rail; and (c) a rail locking element adapted for location between the clipholder and the rail flange, the locking element interfitting with said clipholder in a wedge-like relationship such that movement of the locking element in the longitudinal direction of the rail is translated into a holding force perpendicular to the edge of the rail flange, said locking element being formed of an electrically insulating material and (d) an insulator pad for location between the rail and the tie.

2. A rail fastening system as claimed in claim 1 in which the edges of the curved portions of the arms of the rail clip are coined.

3. A rail fastening system as claimed in claim 1 in which the ends of the arms of the rail clip which lie on the rail flange must be laterally compressed together in order to move these ends of the arms through a gap in the portion of the clipholder lying adjacent the rail flange.

* * * * *